US006230591B1

(12) United States Patent
Ling et al.

(10) Patent No.: US 6,230,591 B1
(45) Date of Patent: May 15, 2001

(54) REVERSIBLE RATCHETING TOOL WITH IMPROVED GEAR WHEEL/PAWL ENGAGEMENT

(75) Inventors: David Ling; Hsien-Chung Tuan-Mu, both of Taichung (TW)

(73) Assignee: Hand Tool Design Corporation, Wilmington, DE (US)

( * ) Notice: Subject to any disclaimer, the term of this patent is extended or adjusted under 35 U.S.C. 154(b) by 0 days.

(21) Appl. No.: 09/364,377

(22) Filed: Jul. 30, 1999

(51) Int. Cl.[7] ..... B25B 13/46
(52) U.S. Cl. ..... 81/63; 81/63.2; 81/60
(58) Field of Search ..... 81/60, 61, 62, 81/63, 63.1, 63.2

(56) References Cited

U.S. PATENT DOCUMENTS

| | | | | |
|---|---|---|---|---|
| 1,957,462 | | 5/1934 | Kress . | |
| 3,337,014 | | 8/1967 | Sandrick . | |
| 4,328,720 | | 5/1982 | Shiel . | |
| 4,520,697 | | 6/1985 | Moetteli . | |
| 4,762,033 | | 8/1988 | Chow . | |
| 4,986,147 | * | 1/1991 | Cooper | 81/63.2 |
| 5,144,869 | | 9/1992 | Chow . | |
| 5,499,560 | * | 3/1996 | Aeschliman | 81/63.2 |
| 5,626,061 | * | 5/1997 | Whitley | 81/63 |
| 5,626,062 | * | 5/1997 | Colvin | 81/63.2 |
| 5,857,390 | * | 1/1999 | Whiteford | 81/62 |
| 5,913,954 | * | 6/1999 | Arnold et al. | 81/63.2 |
| 5,927,158 | * | 7/1999 | Lin | 81/60 |
| 5,957,009 | * | 9/1999 | McCann | 81/63.2 |

* cited by examiner

*Primary Examiner*—Timothy V. Eley
*Assistant Examiner*—Dung Van Nguyen
(74) *Attorney, Agent, or Firm*—Alan Kamrath; Rider Bennett Egan & Arundel, LLP.

(57) ABSTRACT

A ratcheting tool includes a handle and a head in which a gear wheel is rotatably mounted. A pawl is mounted in the head and includes a toothed first side engaged with the gear wheel and a second side facing away from the gear wheel, with the second side of the pawl including two spaced operative sections. A ball is biased to engage with one of the operative sections of the pawl, thereby biasing the pawl teeth to mesh with the gear wheel teeth and biasing the pawl to bear against a wall of the head. A switch member is pivotally mounted to the head and includes a first end engaged with the pawl to move therewith and a second end for manual operation. The switch member is pivotally movable between two positions to optionally cause the ball to engage with one of the operative sections of the pawl, thereby allowing change in ratcheting direction of the ratcheting tool.

20 Claims, 14 Drawing Sheets

REVERSIBLE RATCHETING TOOL WITH IMPROVED GEAR WHEEL/PAWL ENGAGEMENT

BACKGROUND OF THE INVENTION

1. Field of the Invention

The present invention relates to an improved gear wheel/pawl engagement for a reversible ratcheting tool.

2. Description of the Related Art

U.S. Pat. No. 1,957,462 to Kress issued on May 8, 1934 discloses a ratchet wrench including a ratchet wheel 24 housed in a cylindrical recess 23 in the head 22. A pawl 25 is mounted in a second cylindrical recess 26 in the head 22 for controlling movement of the ratchet wheel 24. The pawl 25 is retained in place by a spring-biased plunger 41. Upon rotation of a thumb-piece 58 connected to the pawl 25, the pawl 25 is movable between two positions and thus provides driving and ratcheting of a socket in opposite directions. The pawl 25 is pivoted through a relatively long distance in the head 22, i.e., the head 22 must be relatively large to allow pivotal movement of the pawl 25. Furthermore, the pawl 25 engages with the teeth of the ratchet wheel 24 by only two teeth, i.e., the wrench is not capable of bearing high torque.

U.S. Pat. No. 4,328,720 to Shiel issued on May 11, 1982 discloses a socket wrench including a drive ring 30, a pawl 50 mounted in a recess 52 in the head 21 of the socket wrench and having two toothed portions 56 and 57, and an external latch handle 53 for controlling position of the pawl 50, thereby optionally causing a desired one of the toothed portions 56 and 57 to engage with a ratcheted outer peripheral portion 48 of the drive ring 30 and thus changing the ratcheting direction. Nevertheless, there are too many components in this socket wrench, and the head 21 is relatively large, as it has to receive the components. Processing and assembly for the components are both troublesome and time-consuming. In addition, transmission between the elements for changing the ratcheting direction is not reliable, as the latch handle 53 does not directly actuate the pawl 50. Furthermore, each toothed portion 56, 57 has only two teeth, i.e., the socket wrench is not capable of bearing high torque.

U.S. Pat. No. 5,626,062 to Colvin issued on May 6, 1997 discloses a ratchet wrench including a drive gear 48 mounted in a head 44 thereof. A reversing pawl 60 is mounted in the head 44 and has teeth 62 for engaging the drive teeth 50 of the drive gear 48 to provide driving and ratcheting of the socket 22 in opposite directions that are reversible by movement of the reversing pawl 60 between two positions under control of a reversing lever 102. The reversing pawl 60 is pivoted through a relatively long distance in the head 44, i.e., the head must be large enough to allow pivotal movement of the reversing pawl 60. Furthermore, the pawl 60 engages with the teeth 50 of the drive gear 48 by only two teeth, i.e., the wrench is not capable of bearing high torque.

U.S. Pat. No. 4,762,033 to Chow issued on Aug. 9, 1988 discloses a ratchet wrench including a drive head 30 with inner ratchet teeth 42. A core assembly 34 is rotatably mounted in the drive head 30 and has a tool-coupling stud 56. Mounted in the core assembly 34 is a pawl 46 that engages with the teeth 42. Upon rotation of a control plate 60, the pawl 46 is movable between two positions and thus provides driving and ratcheting of a socket in opposite directions via transmission of an intercoupling, resilient, spring-like wire 104 that is mounted in the core assembly 34. The pawl 46 engages with the teeth 42 by about five teeth and thus may bear higher torque. Nevertheless, the user must use both hands to switch the ratcheting direction. In addition, there are too many components in this wrench, and the head must be relatively large for receiving the components and allowing movement of the pawl 46. Processing and assembly for these components are both troublesome and time-consuming. Furthermore, the wire 104 tends to malfunction as a result of fatigue and thus fails to provide the required switching direction.

U.S. Pat. No. 4,520,697 to Moetteli issued on Jun. 4, 1985 discloses a ratchet wrench including a holed head 22' having inner ratchet teeth 30'. Mounted in the head 22' is a drive member 32' with a hexagonal drive portion 36'. Also mounted in the head 22' is a pawl 54' having a first set of ratchet teeth 58' and a second set of ratchet teeth 60' for selectively engaging with the teeth 30'. A reverser plate 70' is mounted on top of the drive member 32' and includes two reverser pins 74' for connection with the pawl 54'. The ratcheting action is reversible by merely moving the reverser pins 74'. Nevertheless, there are too many components in this wrench, and the head is large, as it has to receive the components. In addition, processing and assembly are both troublesome and time-consuming. Furthermore, the pawl 54' engages with the teeth 30' by only two teeth, i.e., the wrench is not capable of bearing high torque.

U.S. Pat. No. 3,337,014 to Sandrick issued on Aug. 22, 1967 discloses a ratchet wrench including a head 10 provided with internal periphery ratchet teeth 15. Mounted in the head 10 is a double-ended pawl 26 that is pivotable by a spring pressed plunger 38. Upon rotation of a finger piece 36, the pawl 26 is movable between two positions and thus provides driving and ratcheting of a socket in opposite directions. Nevertheless, there are too many components in this wrench, and the head is large, as it has to receive the components. In addition, processing and assembly are both troublesome and time-consuming. The pawl 26 engages with the teeth 15 by only three teeth, i.e., the wrench is not capable of bearing high torque. Furthermore, the user must use both hands to switch the ratcheting direction.

U.S. Pat. No. 5,144,869 to Chow issued on Sep. 8, 1992 discloses a ratchet wrench including a handle with two box ends each having a ratchet wheel 12 mounted therein. A pawl 20 is engaged with each ratchet wheel 12. A knob 30 is mounted in a middle of the handle and receives a disc 40 that is connected to each pawl 20 by two resilient members 26. When the knob 30 and the disc 40 are rotated, the first toothed section 22 and the second toothed section 23 of each pawl 20 are caused to engage with the associated ratchet wheel 12 via transmission by the resilient members 26, thereby controlling the torque transmission direction of the ratchet wheel 12. Nevertheless, the resilient members 26 tend to malfunction as a result of fatigue. In addition, position of each pawl 20 cannot be precisely controlled. The handle structure is weak, as it must be machined to provide a space for receiving the knob 30, the resilient members 26, and the pawls 20. Furthermore, each pawl 20 engages with the ratchet wheel 12 by only two teeth, i.e., the wrench is not capable of bearing high torque.

FIG. 14 of the drawings illustrates a ratcheting tool including a head 11' having a first compartment 121' for receiving a drive member 20' with a ratchet wheel 21', a second compartment 122' for receiving a pawl 30', and a third compartment 123' for receiving a switch block 40'. The pawl 30' includes teeth 31' formed on a first side thereof for engaging with teeth of the ratchet wheel 21'. The switch block 40' includes a first side having two operative sections 416' for selectively bearing against a second side of the pawl 30'. A second side of the switch block 40' includes two arcuate grooves 414'. A thumb piece 42' includes a stem 421' that extends through a hole 13' in the head 11', a vertical hole 413' in the switch block 40', and a hole 71' of a cover 70'. A spring 61' is mounted in a cavity 14' in the web area of the tool for urging a ball 62' to engage with one of the grooves 414'. An elastic ring 50' is wound around a stub 411' on the switch block 40' and includes an engaging end 51' engaged in a hole 32' of the pawl 30'. Upon rotation of the thumb piece 42', the pawl 30' is movable between two positions and thus provides driving and ratcheting of a socket in opposite directions via transmission of the switch block 40' and the elastic ring 50'. The pawl 30' engages with the ratchet wheel teeth by more teeth and thus may bear higher torque. Nevertheless, the pawl 30' has a long travel in the head 11', and the head 11' must be relatively large for receiving the ratchet wheel 21', the pawl 30', and the switch block 40' and allowing pivotal movement of the pawl 30' and the switch block 40'. In addition, the elastic ring 50' is required for transmitting the force from the switch block 40' to the pawl 30' so as to change the ratcheting direction. More specifically, position of the pawl 30' cannot be precisely controlled. In addition, the elastic ring 50' tends to malfunction as a result of fatigue.

In conclusion, the above-mentioned conventional ratcheting tools fail to provide high torque operation, as most of the pawls merely engage with the ratchet wheel by at best three or five teeth. The head of the ratcheting tool has to be relatively large for accommodating those components and thus is difficult to be used in a limited space. Generally, a skilled user uses a combination wrench, a spanner with two open ends, or a ring spanner for tightening or loosening a fastener in a limited space. Yet, it is found that free rotation of the ratcheting tool during ratcheting is too large (larger than the theoretic value of 5°), as the pawl has a long travel.

The present invention is intended to provide an improved gear wheel/pawl engagement for a reversible ratcheting tool that mitigates and/or obviates the above problems.

SUMMARY OF THE INVENTION

It is a primary object of the present invention to provide a reversible ratcheting tool with an improved gear wheel/pawl engagement to thereby provide improved driving torque while keeping the head to a minimum size.

A ratcheting tool in accordance with the present invention comprises:

a handle;

a head extending from the handle and having a first compartment and a second compartment communicating with the first compartment;

a gear wheel rotatably mounted in the first compartment, the gear wheel including an outer periphery with a plurality of first teeth;

a pawl mounted in the second compartment and including a first side with a plurality of second teeth facing the first teeth of the gear wheel and a second side facing away from the gear wheel, the second side of the pawl including two spaced operative sections;

a biasing means mounted in the second compartment and in operative contact with one of the operative sections of the second side of the pawl for biasing the pawl toward the gear wheel such that the second teeth of the pawl mesh with the first teeth of the gear wheel and for biasing the pawl to bear against a wall defining the second compartment; and a switch member pivotally mounted to the head and including a first end engaged with the pawl to move therewith and a second end for manual operation, the switch member being pivotally movable between two positions to optionally cause the biasing means to engage with one of the operative sections of the pawl, thereby allowing change in ratcheting direction of the ratcheting tool.

A web area between the handle and the head includes a cavity for receiving the biasing means. The biasing means includes a ball partially received in the cavity for releasably engaging with one of the operative sections and an elastic member in the cavity for biasing the ball toward said one of the operative sections.

Each operative section is a groove having a rectilinear section that is at an angle with a longitudinal direction of the handle. The rectilinear sections of the grooves are spaced by a ridge. The pawl is disengaged from the gear wheel and the ball slides over the ridge during transition from said one of the grooves to the other of the grooves.

The pawl includes a vertical slot, and the first end of the switch member includes a peg slidably received in the vertical slot such that pivotal movement of the switch member causes the peg to slide along the vertical slot and thus urge the pawl to move relative to the gear wheel and the biasing means.

The gear wheel may include an inner periphery for releasably engaging with a fastener. Alternatively, the gear wheel includes a drive member extended therefrom for releasably engaging with a socket.

In a preferred embodiment of the invention, a ratcheting tool comprises:

a handle;

a head extending from the handle and having a first compartment and a second compartment communicating with the first compartment, a web area being defined between the head and the handle and including a cavity;

a gear wheel rotatably mounted in the first compartment, the gear wheel including an inner periphery adapted to be engaged with a fastener and an outer periphery with a plurality of first teeth;

a pawl mounted in the second compartment and including a first side with a plurality of second teeth facing the first teeth of the gear wheel and a second side facing away from the gear wheel, the second side of the pawl including two grooves spaced by a ridge, the pawl further including a vertical slot;

a ball partially received in the cavity and in operative contact with one of the grooves of the pawl;

an elastic member mounted in the cavity for biasing the pawl toward the gear wheel such that the second teeth of the pawl mesh with the first teeth of the gear wheel and for biasing the pawl to bear against a wall defining the second compartment; and a switch member pivotally mounted to the head and including a first end engaged with the pawl and a second end for manual operation, the switch member being pivotally movable between two positions to optionally cause the ball to engage with one of the grooves of the pawl, thereby allowing change in ratcheting direction of the ratcheting tool, the first end of the switch member including a peg slidably received in the vertical slot such that pivotal movement of the switch member causes the peg to slide along the vertical slot and thus urges the pawl to move relative to the gear wheel and the ball.

In another preferred embodiment of the invention, a ratcheting tool comprises:

a handle;

a head extending from the handle and having a first compartment and a second compartment communicating with the first compartment, a web area being defined between the head and the handle and including a cavity;

a gear wheel rotatably mounted in the first compartment, the gear wheel including a drive member extending therefrom and adapted to be engaged with a fastener, the gear wheel further including an outer periphery with a plurality of first teeth;

a pawl mounted in the second compartment and including a first side with a plurality of second teeth facing the first teeth of the gear wheel and a second side facing away from the gear wheel, the second side of the pawl including two grooves spaced by a ridge, the pawl further including a vertical slot;

a ball partially received in the cavity and in operative contact with one of the grooves of the pawl;

an elastic member mounted in the cavity for biasing the pawl toward the gear wheel such that the second teeth of the pawl mesh with the first teeth of the gear wheel and for biasing the pawl to bear against a wall defining the second compartment; and a switch member pivotally mounted to the head and including a first end engaged with the pawl and a second end for manual operation, the switch member being pivotally movable between two positions to optionally cause the ball to engage with one of the grooves of the pawl, thereby allowing change in ratcheting direction of the ratcheting tool, the first end of the switch member including a peg slidably received in the vertical slot such that pivotal movement of the switch member causes the peg to slide along the vertical slot and thus urges the pawl to move relative to the gear wheel and the ball.

The ratcheting tool in accordance with the present invention may bear much higher torque and has a minimum free rotating angle that is very useful when operating in a limited space. In addition, the ratcheting direction can be changed by easy operation of the switch member. The arrangement for achieving the ratcheting direction switching is simple and thus keeps the head to a minimum size by means of providing a switch member with a peg that is received in the vertical slot of the pawl.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
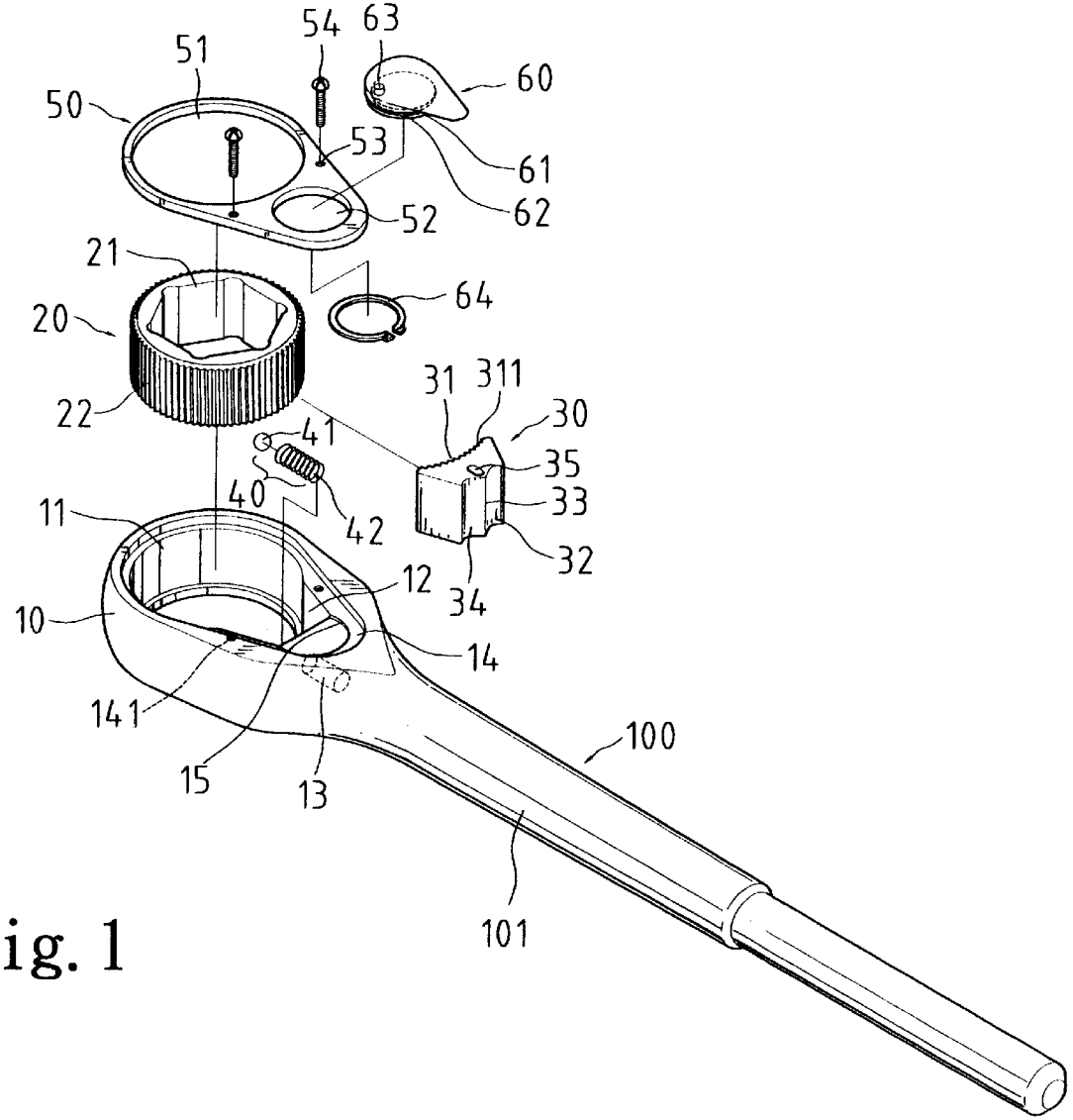
FIG. 1 is a perspective view, partly exploded, of a reversible ratcheting tool in accordance with the present invention.
Figure 2:
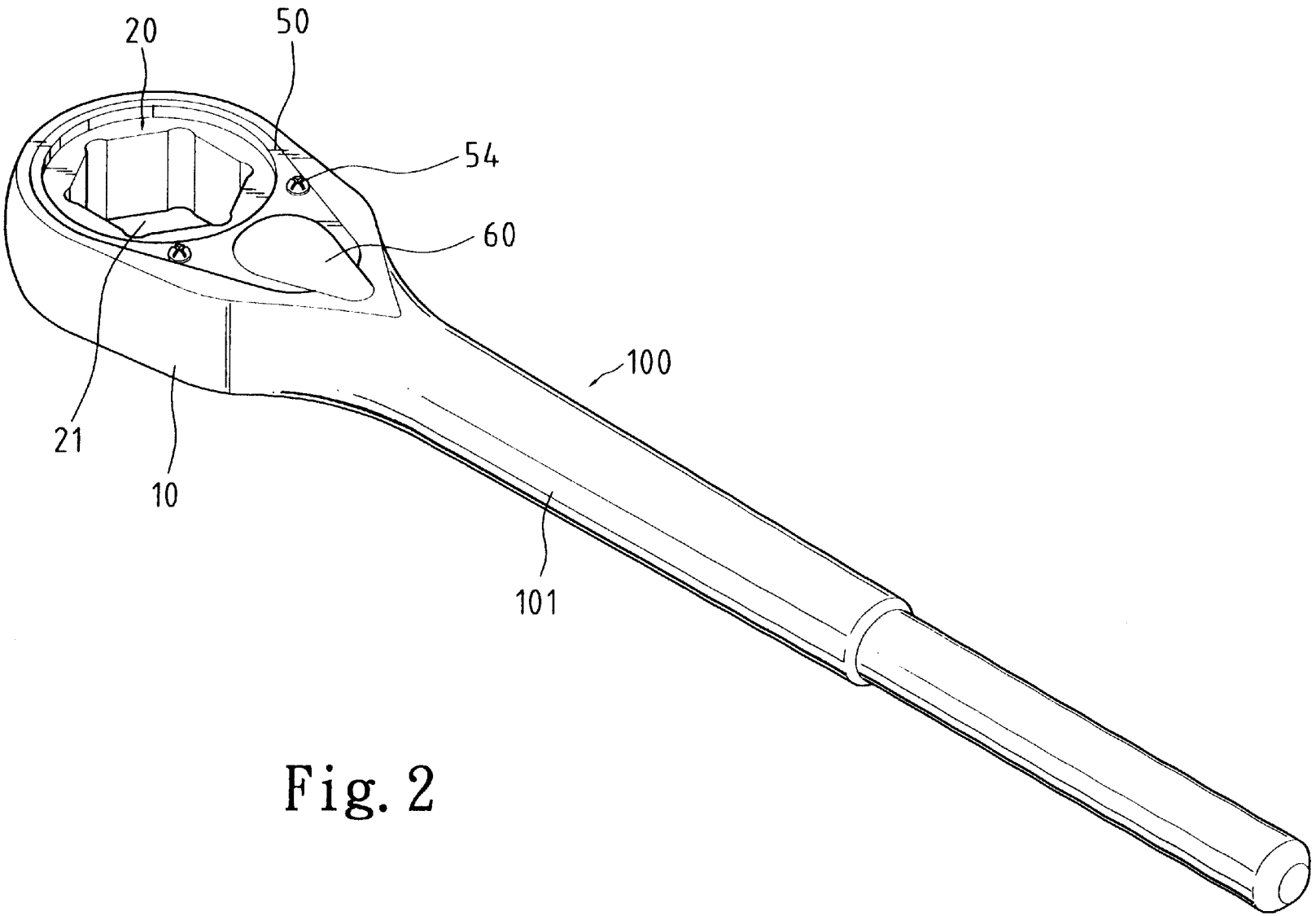
FIG. 2 is a perspective view of the reversible ratcheting tool in accordance with the present invention.

Referring to FIGS. 1 through 13 and initially to FIGS. 1 and 2, a ratcheting tool in accordance with the present invention is designated by 100 and has a handle 101 and a head 10 extended from the handle 101. The head 10 includes a relatively larger first compartment 11 and a relatively smaller compartment 12 communicating with the first compartment 11. A wall that defines the second compartment 12 includes a cavity 13 which is preferably located in a web area (not labeled) between the handle 101 and the head 10. The head 10 further includes a recessed section 14 in a top face thereof, the recessed section 14 including a ledge 15 proximal to the second compartment 12.

Rotatably mounted in the first compartment 11 is a gear wheel 20 that includes an inner periphery 21 for engaging with a fastener (e.g., a nut or bolt head) to be tightened or loosened and a plurality of teeth 22 in an outer periphery thereof. A pawl 30 is mounted in the second compartment 12 and includes an arcuate first side 31 facing the gear wheel teeth 22. The arcuate first side 31 has a plurality of teeth 311 for engaging with the gear wheel teeth 22. The pawl 30 further includes a second side 32 facing away from the gear wheel 20. The second side 32 includes two operative sections, e.g., two arcuate grooves 34 spaced by a ridge 33. Preferably, each arcuate groove 34 includes a rectilinear section 36 (FIG. 3) that is adjacent to the ridge 33 and at an angle with a longitudinal direction of the handle 101. The pawl 30 further includes a vertical slot 35 that is preferably aligned with the ridge 33.

A biasing means 40 is mounted in the cavity 13. In this embodiment, the biasing means 40 includes a ball 41 engaged with either one of the grooves 34 and an elastic member 42 for biasing the ball 41 to engage with the rectilinear section 36 of the groove 34.

A cover 50 configured corresponding to the head 10 is mounted in the recessed section 14 and includes a first opening 51 that aligns with the first compartment 11 and a second opening 52 that aligns with the second compartment 12. The cover 50 further includes two holes 53 aligned with two screw holes 141 in the recessed section 14. Screws 54 are mounted through the holes 53 and 141 to secure the cover 50 to the head 10.

A switch member 60 includes a protrusion 61 formed on an end thereof and extended through the second opening 52 of the cover 50 into the second compartment 12. A peg 63 projects from the protrusion 61 into the vertical slot 35 of the pawl 30. The protrusion 61 further includes an annular groove 62 in an outer periphery thereof, and a C-clip 64 is mounted in the annular groove 62 for pivotally retaining the switch member 60 in the second compartment 12 of the head 10. The protrusion 61 rests on the ledge 15 of the recessed section 14 to provide a stable support for the switch member 60.

Figure 3:
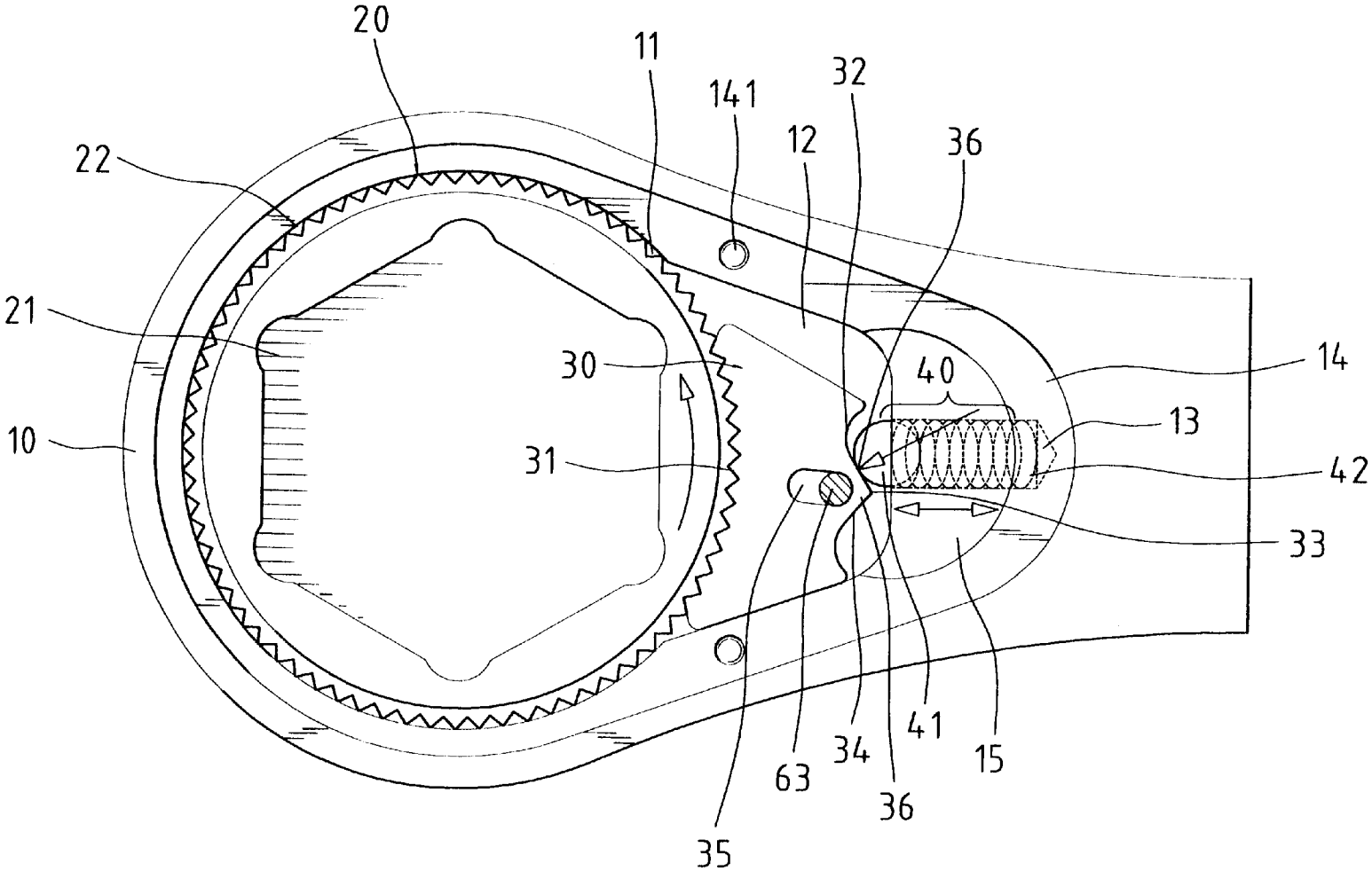
FIG. 3 is a sectional view, in an enlarged scale, of an end portion of the reversible ratcheting tool in accordance with the present invention.
Figure 4:
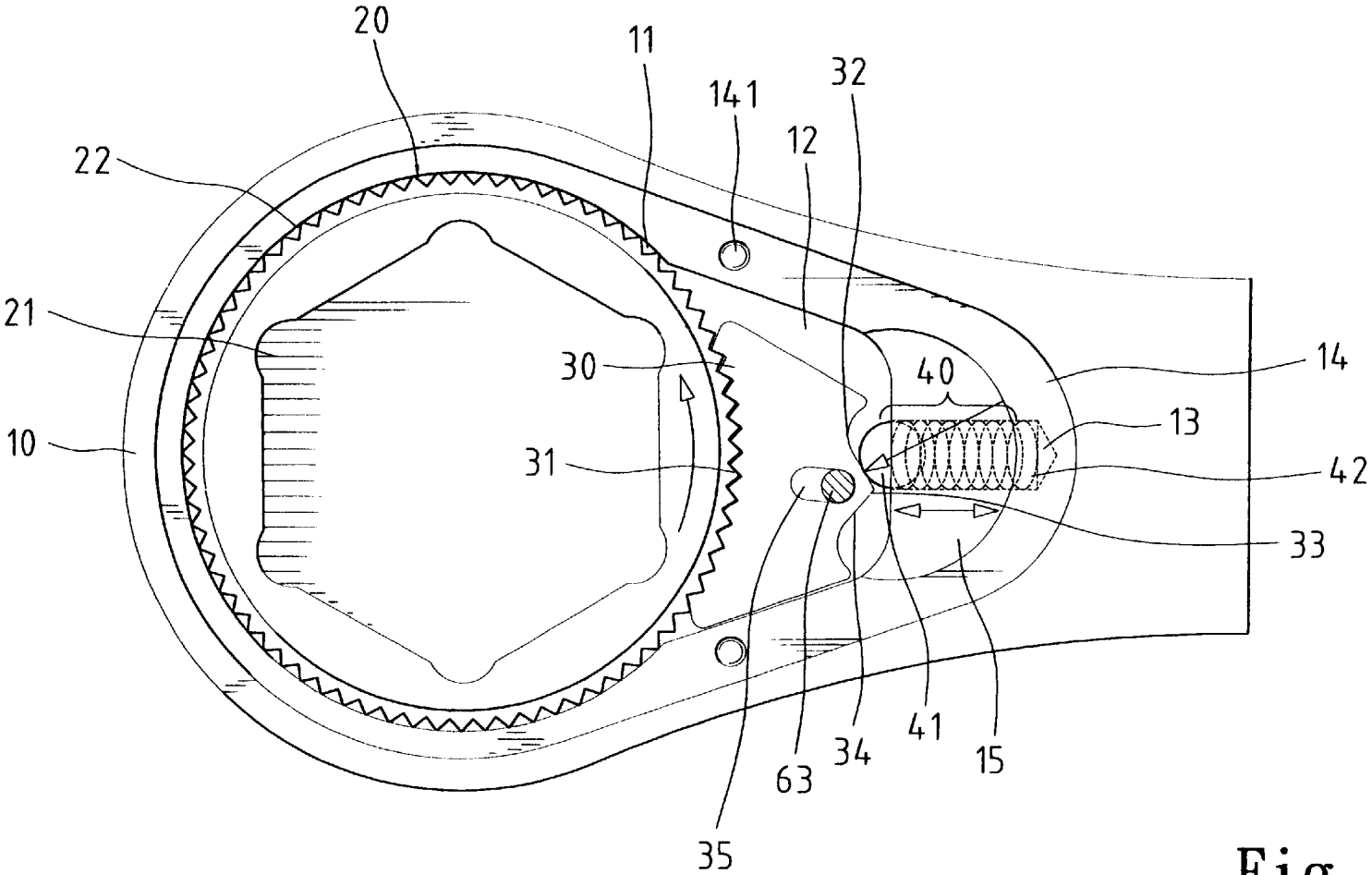
FIG. 4 is a sectional view similar to FIG. 3, wherein the gear wheel of the reversible ratcheting tool is rotated through 1°.
Figure 5:
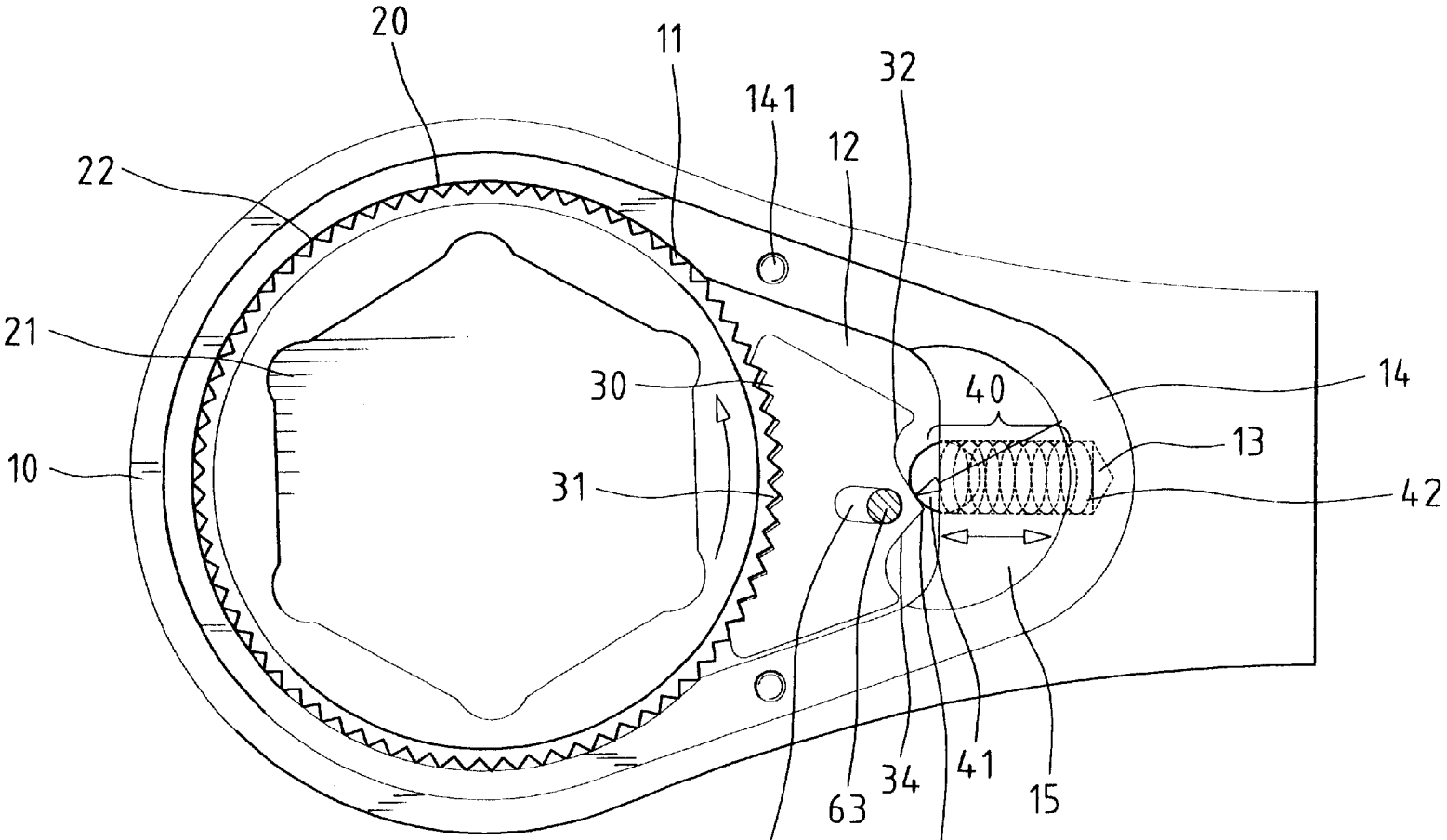
FIG. 5 is a sectional view similar to FIG. 3, wherein the gear wheel of the reversible ratcheting tool is rotated through 2°.
Figure 6:
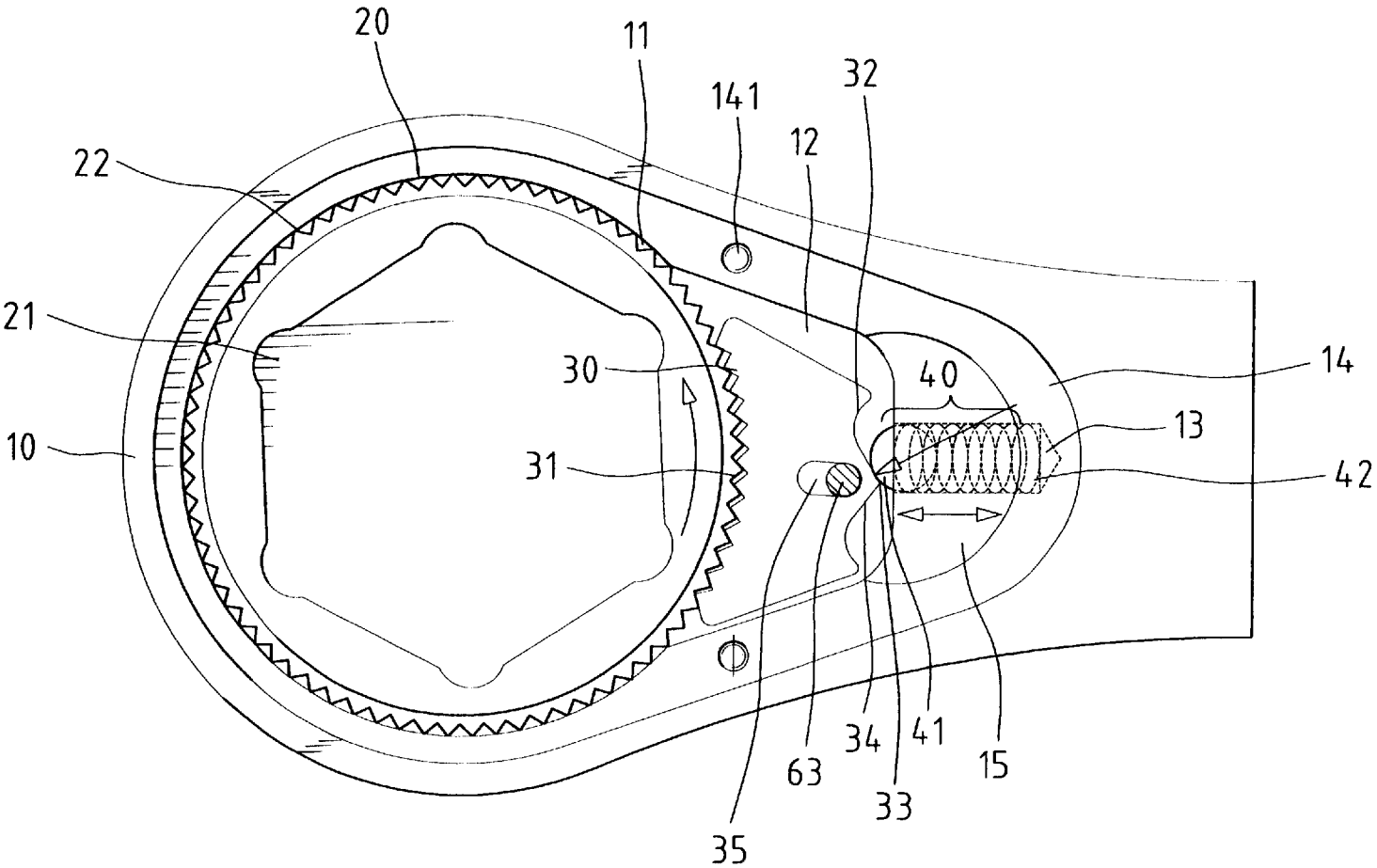
FIG. 6 is a sectional view similar to FIG. 3, wherein the gear wheel of the reversible ratcheting tool is rotated through 3°.
Figure 7:
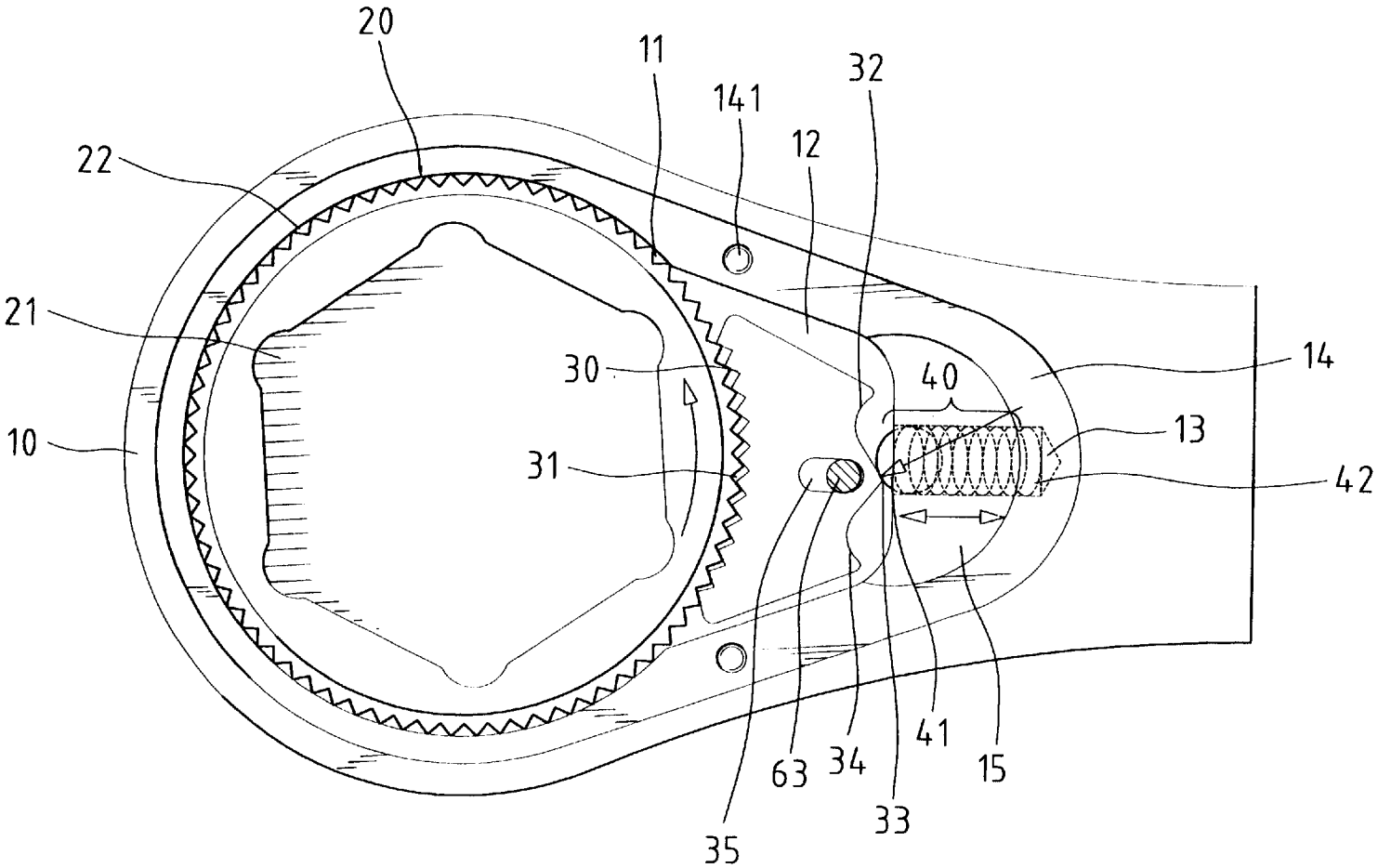
FIG. 7 is a sectional view similar to FIG. 3, wherein the gear wheel of the reversible ratcheting tool is rotated through 4°.
Figure 8:
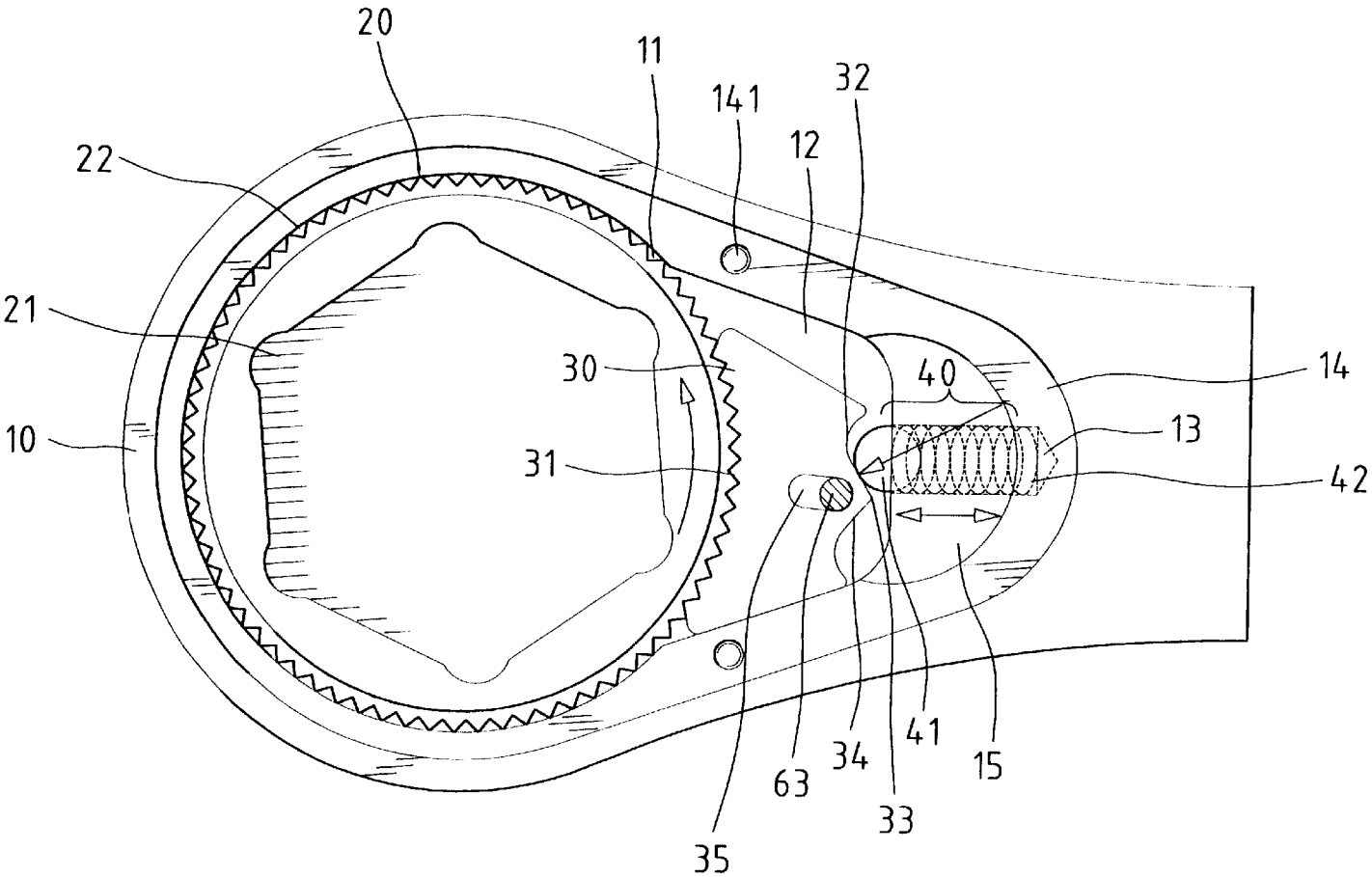
FIG. 8 is a sectional view similar to FIG. 3, wherein the gear wheel of the reversible ratcheting tool is rotated through 5°.

The ratcheting tool after assembly is shown in FIG. 3. It is appreciated that the pawl 30 engages with the gear wheel 20 by at least twelve (12) teeth and thus may bear higher torque during ratcheting. It is noted that the ball 41 exerts a force on the rectilinear section 36 of the groove 34 of the second side 32 of the pawl 30 under the action of the elastic member 42. As a result, the force is imparted into a radial force to urge the pawl 30 along the radial direction (the horizontal direction, as seen from FIG. 3) to securely engage with the teeth 22 of the gear wheel 20 and a downward force (as seen from FIG. 3) to urge the pawl 30 to bear against the wall defining the second compartment 12. Thus, the torque acting on the pawl 30 during ratcheting is transmitted to the wall defining the second compartment 12.

FIGS. 4 through 8 illustrate free rotation of the gear wheel 20. It is noted that the pawl 30 re-engages with the gear wheel teeth 22 after the gear wheel 20 is rotated through 5° (for a gear wheel with seventy-two (72) teeth). More specifically, the ratcheting tool has a minimum free rotating angle during ratcheting, which is impossible to be achieved by conventional ratcheting tools.

Figure 9:
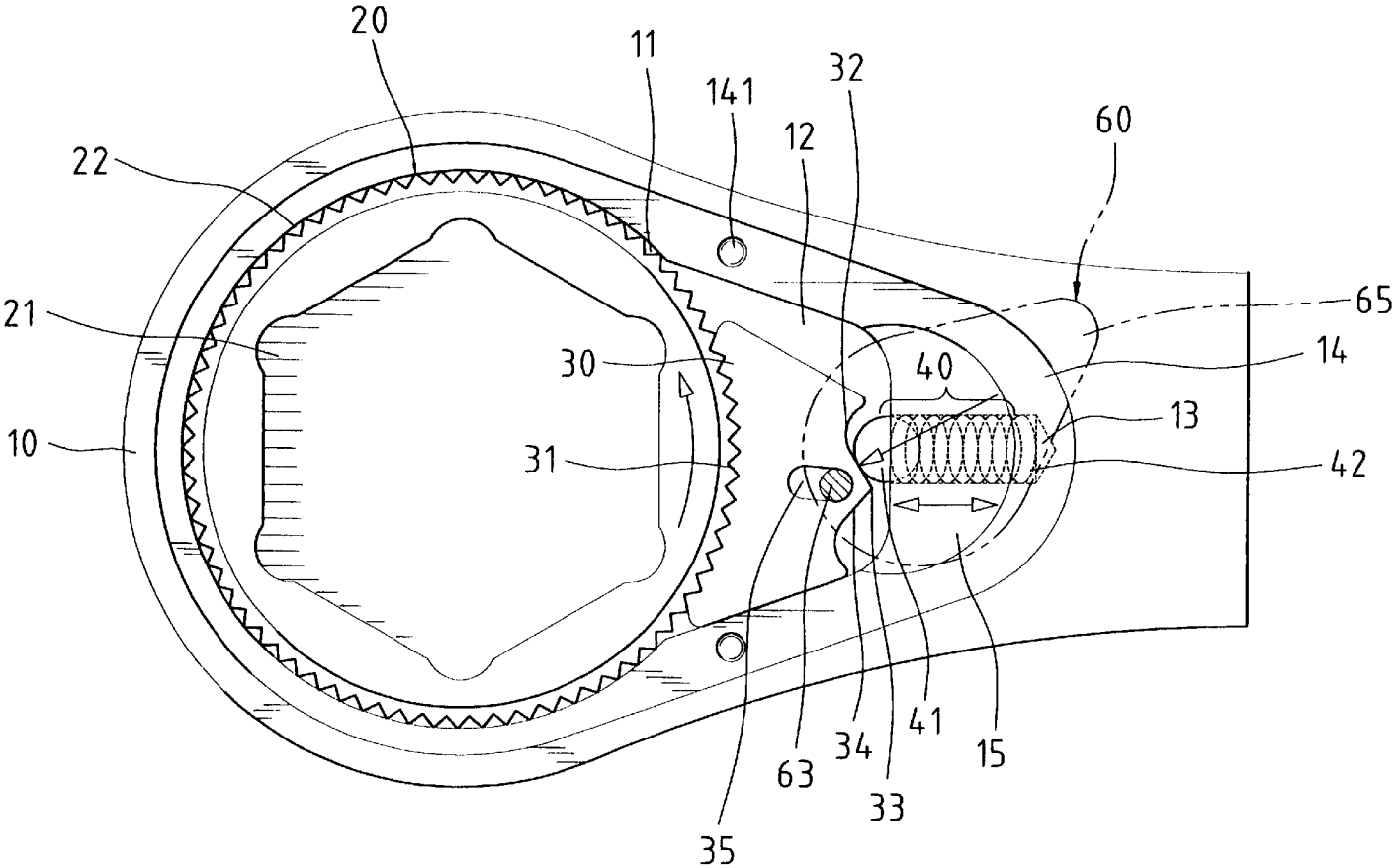
FIG. 9 is a sectional view similar to FIG. 3, wherein the ball is retained in one groove in the pawl.
Figure 10:
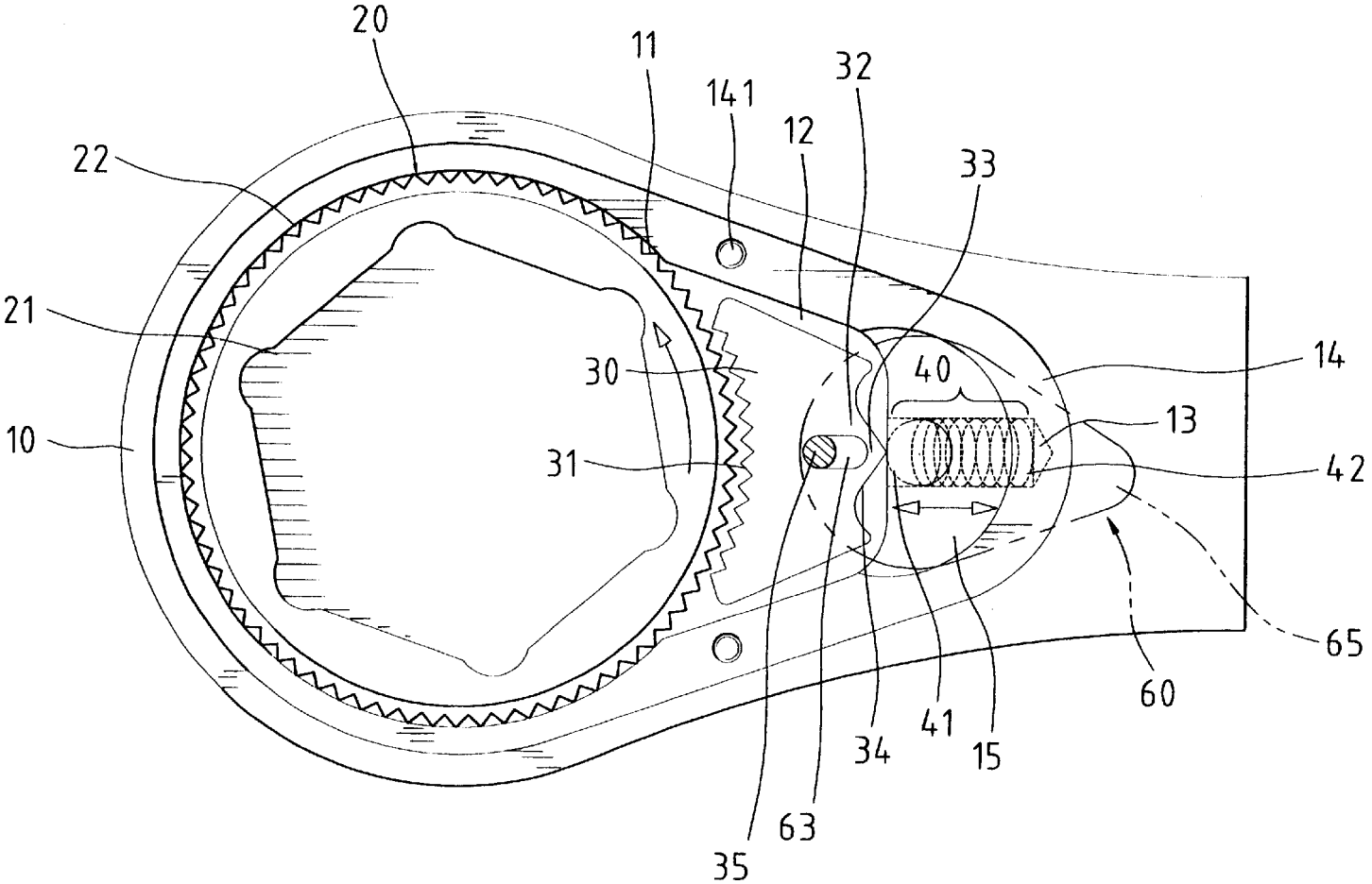
FIG. 10 is a sectional view similar to FIG. 9, wherein the ball is moved to a position between the two grooves in the pawl.

The ratcheting tool shown in FIG. 9 is in a status ready for ratcheting clockwise. Namely, counterclockwise rotation of the gear wheel 20 is free rotation. When the ratcheting direction is to be changed, the user may pivot an operative end 65 of the switch member 60 (by the thumb of the hand that grasps the handle 101) from its upper position (see FIG. 9) to a middle position shown in FIG. 10. The peg 63 of the switch member 60 moves from an end of the slot 35 of the pawl 30 that is proximal to the ball 41 to the other end of the slot 35 that is distal to the ball 41. The pawl 30 actuated by the operative peg 63 moves toward the ball 41 and thus urges the ball 41 into the cavity 13 and compresses the elastic member 42. As illustrated in FIG. 10, the pawl 30 disengages from the gear wheel teeth 22 when the operative end 65 of the switch member 60 is in its middle position.

Figure 11:
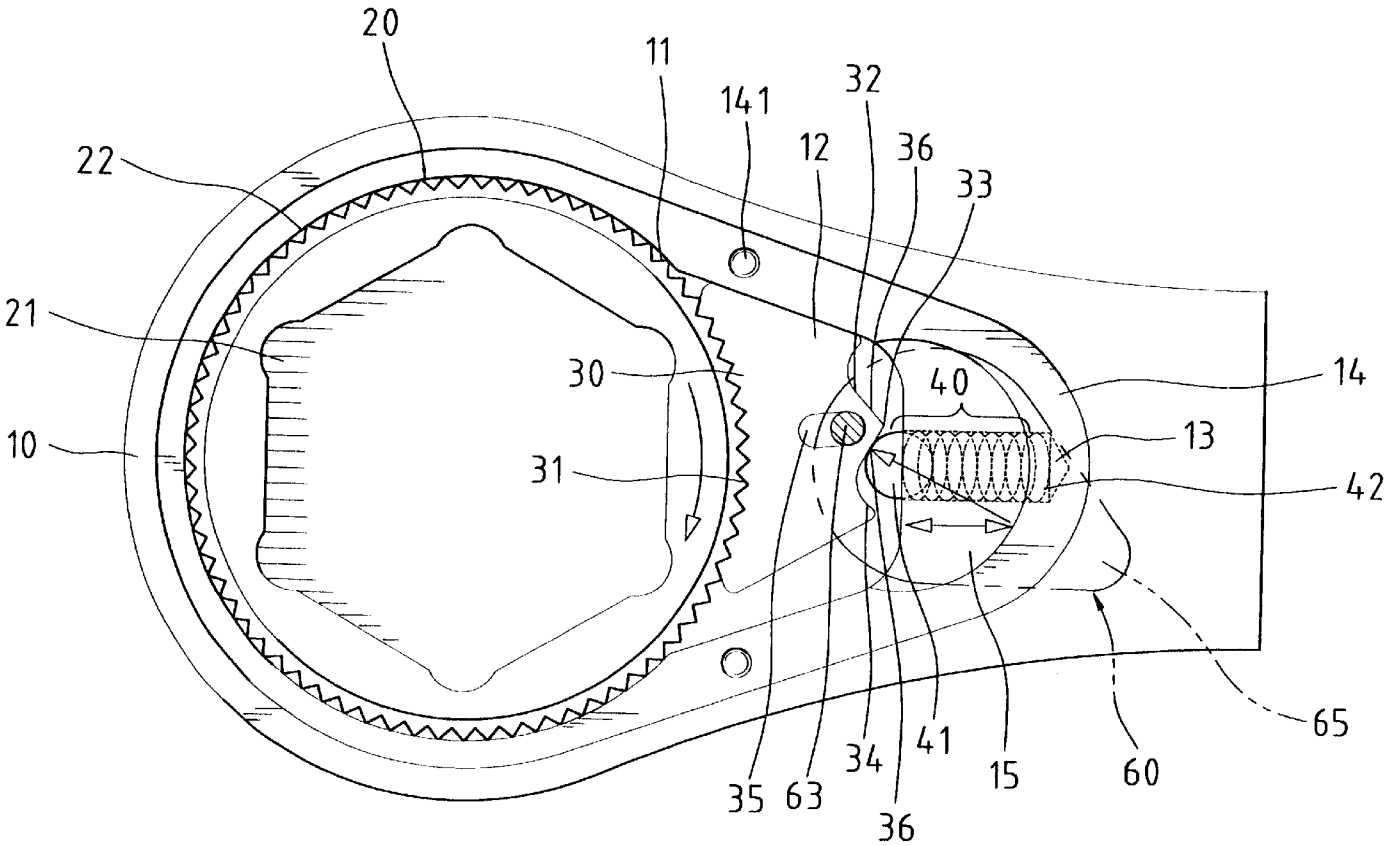
FIG. 11 is a sectional view similar to FIG. 9, wherein the ball has been moved into the other groove in the pawl.

Referring to FIG. 11, further pivotal movement of the operative end 65 of the switch member 60 to its lower position causes the peg 63 of the switch member 60 to move from the other end of the slot 35 of the pawl 30 that is distal to the ball 41 back to the end of the slot 35 that is distal to the ball 41. The pawl 30 actuated by the operative peg 63 moves away from the ball 41 under action of the elastic member 42 to re-engage with the gear wheel teeth 22. In addition, the ball 41 slides over the ridge 33 into the other groove 34. Thus, ratcheting tool shown in FIG. 11 is in a status ready for ratcheting counterclockwise. Namely, clockwise rotation of the gear wheel 20 is free rotation. The ball 41 exerts a force on the rectilinear section 36 of the other groove 34 under the action of the elastic member 42. The force is imparted into a radial force to urge the pawl 30 along the radial direction to securely engage with the teeth 22 of the gear wheel 20 and a downward force to urge the pawl 30 to bear against the wall defining the second compartment 12. Thus, the torque acting on the pawl 30 during ratcheting is transmitted to the wall defining the second compartment 12.

Figure 12:
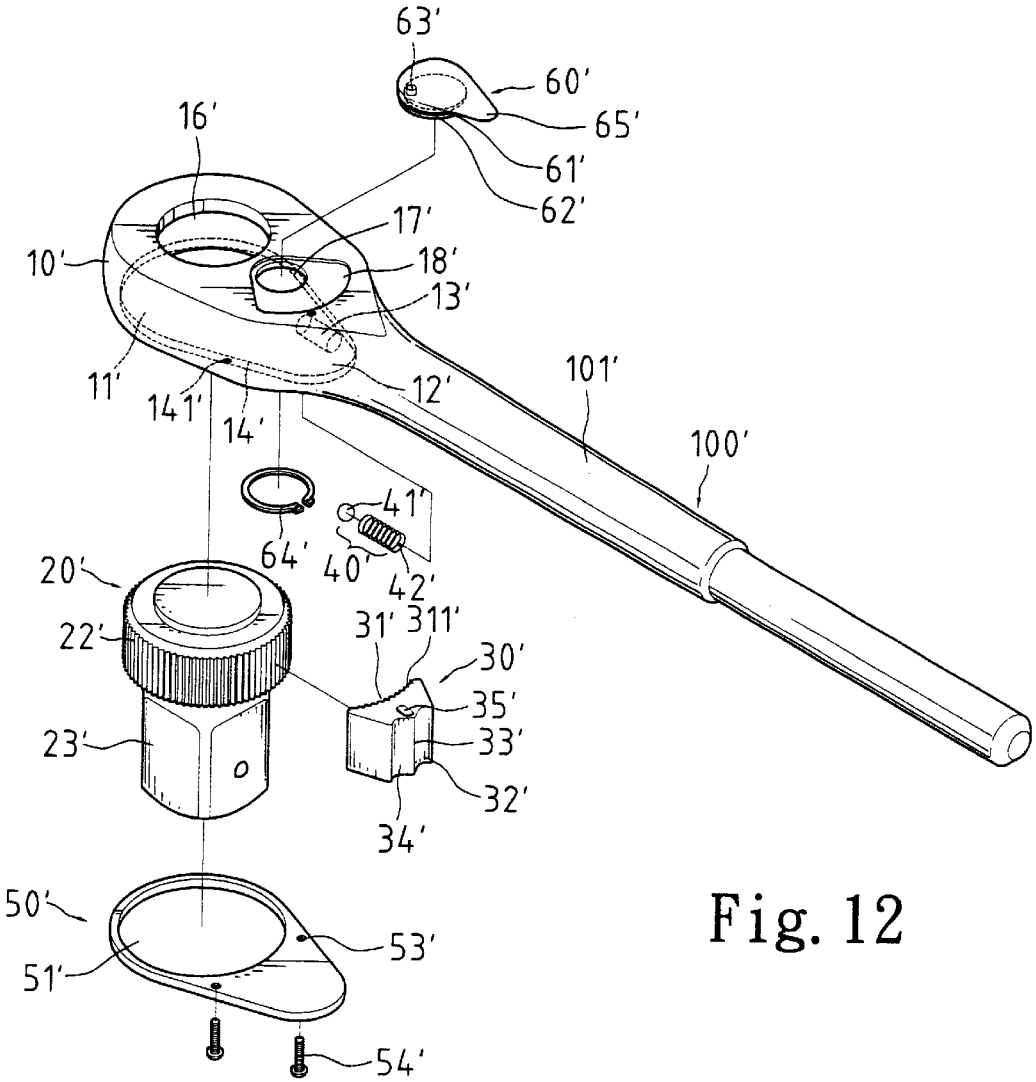
FIG. 12 is a perspective view, partly exploded, of a second embodiment of the reversible ratcheting tool in accordance with the present invention.
Figure 13:
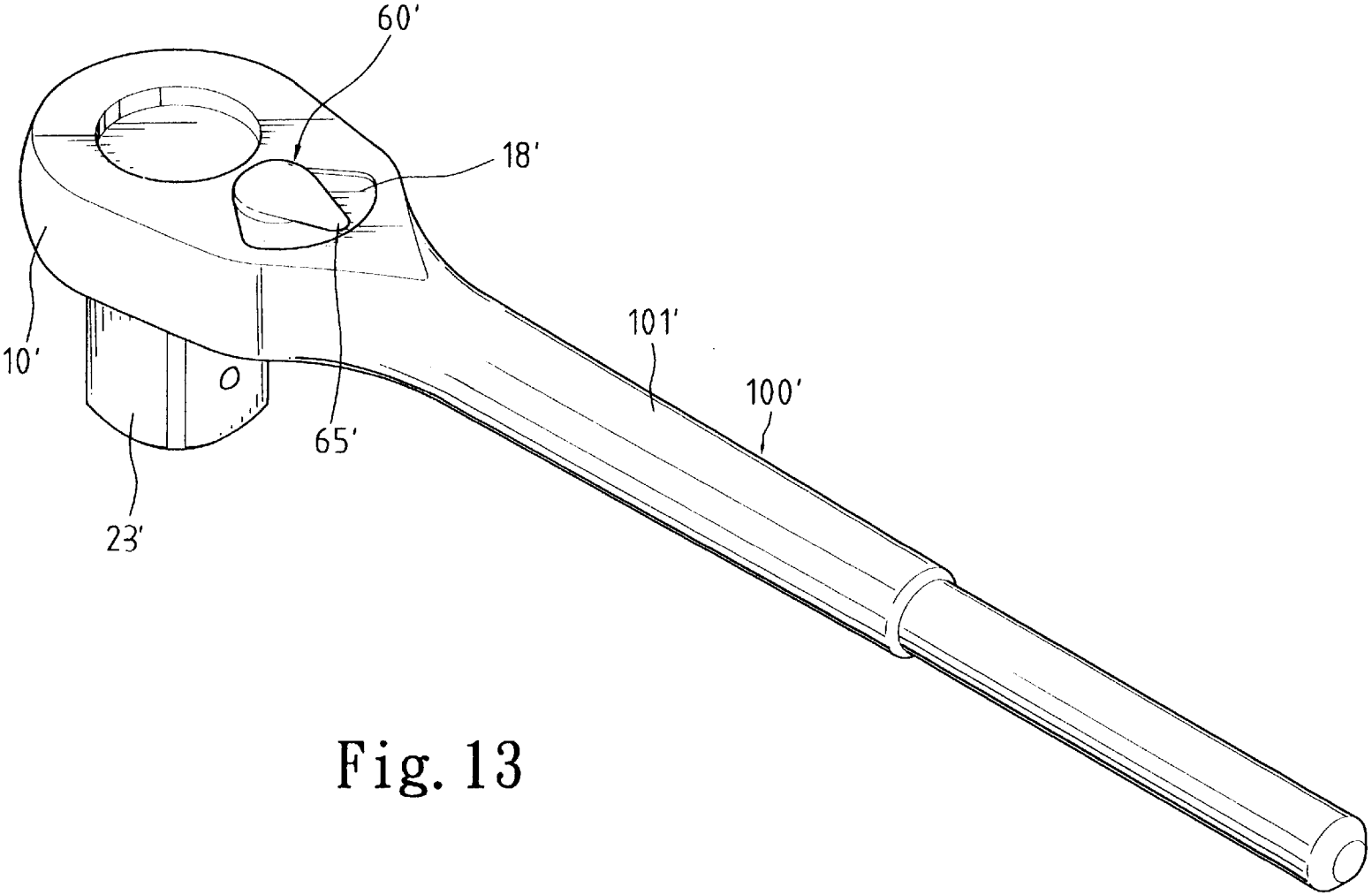
FIG. 13 is a perspective view of the reversible ratcheting tool in FIG. 12.
Figure 14:
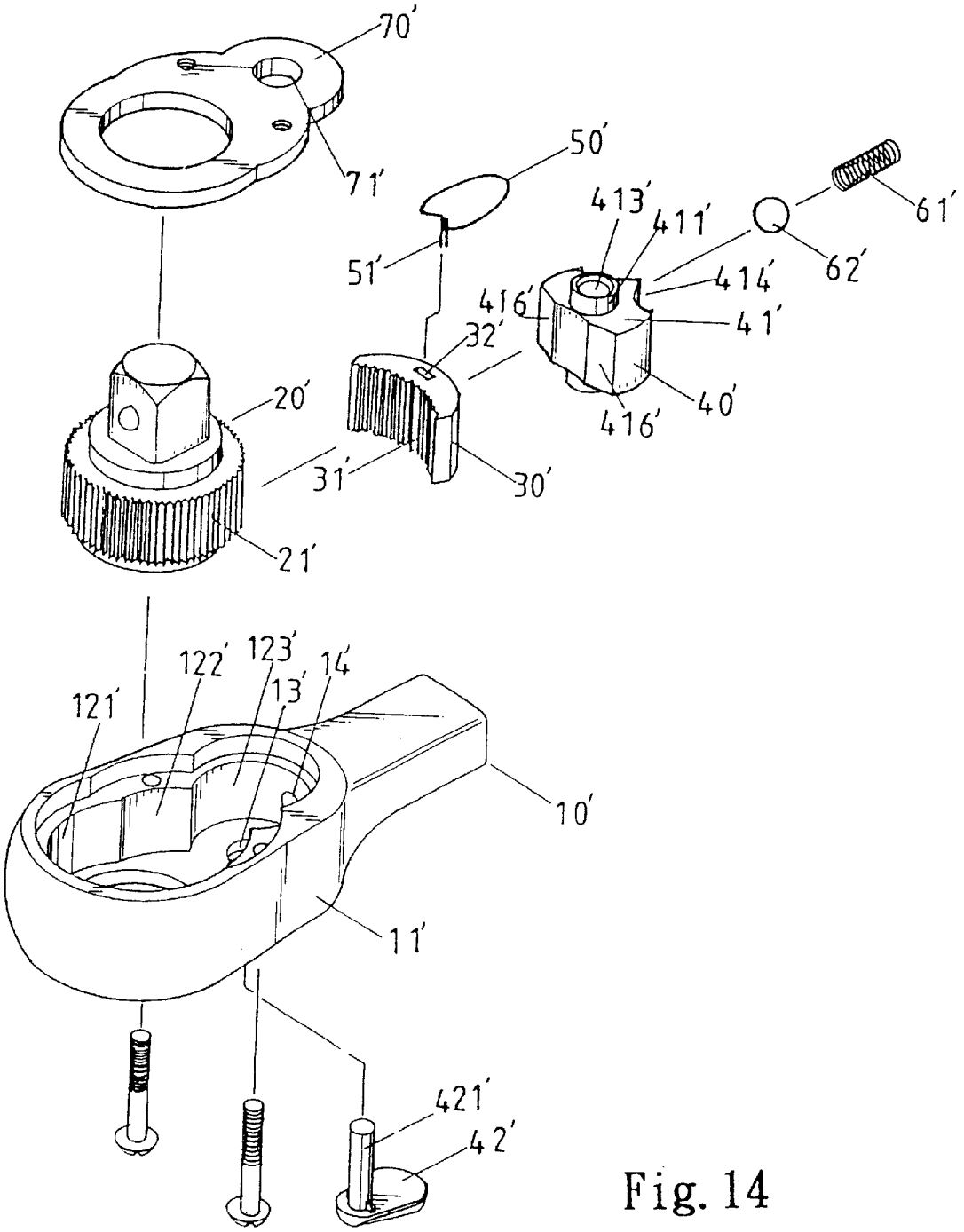
Fig. 14 PRIOR ART
FIG. 14 is an exploded perspective view of a conventional ratcheting tool.

FIGS. 12 and 13 illustrate another embodiment of the invention, wherein like elements are designated by like reference numerals except that the reference numerals are suffixed with a prime. In this embodiment, the ratcheting tool 100' has a handle 101' and a head 10' extended from the handle 101'. The head 10' includes a relatively larger first compartment 11' and a relatively smaller compartment 12' communicated with the first compartment 11'. A wall that defines the second compartment 12' includes a cavity 13' which is preferably located in a web area (not labeled) between the handle 101' and the head 10'. A top face of the head 10' includes a first opening 16' that communicates with the first compartment 11' and a second opening 17' that communicates with the second compartment 12'. A sector-like recessed section 18' is formed around the second opening 17'. The head 10' further includes a recessed section 14' in a bottom thereof, the recessed section 14' including two screw holes 141'.

Rotatably mounted in the first compartment 11' is a gear wheel 20' that includes a plurality of teeth 22' in an outer periphery thereof. A drive member 23' extends from the gear wheel 20' for releasably engaging with a socket and. A pawl 30' is mounted in the second compartment 12' and includes an arcuate first side 31 ' facing the gear wheel teeth 22'. The arcuate first side 31 ' has a plurality of teeth 311'. The pawl 30' further includes a second side 32' facing away from the gear wheel 20'. The second side 32' includes two operative sections, e.g., two arcuate grooves 34' spaced by a ridge 33'. Preferably, each groove 34' includes a rectilinear section that is adjacent to the ridge 33' and at an angle with a longitudinal direction of the handle 101'. The pawl 30' further includes a vertical slot 35' that is preferably aligned with the ridge 33'.

A biasing means 40' is mounted in the cavity 13'. In this embodiment, the biasing means 40' includes a ball 41' engaged with either one of the grooves 34' and an elastic member 42' for biasing the ball 41' to engage with the groove 34'. Thus, the pawl 30' will engage with the gear wheel teeth 22' by at least twelve (12) teeth such that the ratcheting tool may bear higher torque during ratcheting.

A cover 50' configured corresponding to the head 10' is mounted in the recessed section 14' and includes an opening 51' through which the drive member 23' extends. The cover 50' further includes two holes 53' aligned with the screw holes 141' in the recessed section 14'. Screws 54' are mounted through the holes 53' and 141' to secure the cover 50' to the head 10'.

A switch member 60' is pivotally mounted in the sector-like recessed section 18' of the head 10'. The switch member 60' includes a protrusion 61' formed on an end thereof and extended through the second opening 17' into the second compartment 12'. A peg 63' projects from the protrusion 61' into the vertical slot 35' of the pawl 30'. The protrusion 61' further includes an annular groove 62' in an outer periphery thereof, and a C-clip 64' is mounted in the annular groove 62' for pivotally mounting the switch member 60' to the head 10'. The switch member 60' further includes an operative end 65' for proceeding with pivotal movement, which is identical to the above embodiment.

The embodiment shown in FIGS. 12 and 13 provides a ratcheting tool structure for engaging with sockets of various sizes. Detailed ratcheting direction switching operation and ratcheting operation of this embodiment are identical to those of the first embodiment and therefore not described in detail to avoid redundancy.

According to the above description, it is appreciated that the ratcheting tool in accordance with the present invention may bear much higher torque and has a minimum free rotating angle that is very useful when operating in a limited space. In addition, the ratcheting direction can be changed by easy operation of the switch member. The arrangement for achieving the ratcheting direction switching is simple and thus keeps the head in a minimum size by means of providing a switch member with a peg that is received in the vertical slot of the pawl.

Although the invention has been explained in relation to its preferred embodiment, it is to be understood that many other possible modifications and variations can be made without departing from the spirit and scope of the invention as hereinafter claimed.

What is claimed is:

1. A ratcheting tool comprising, in combination:

a handle;

a head extending from the handle and having a first compartment and a second compartment communicating with the first compartment;

a gear wheel rotatably mounted in the first compartment, the gear wheel including an outer periphery with a plurality of first teeth;

a pawl mounted in the second compartment and including a first side with a plurality of second teeth facing the first teeth of the gear wheel and a second side facing away from the gear wheel, the second side of the pawl including two spaced operative sections;

a biasing means mounted in the second compartment and in operative contact with one of the operative sections of the second side of the pawl for biasing the pawl toward the gear wheel such that the second teeth of the pawl mesh with the first teeth of the gear wheel and for biasing the pawl to bear against a wall defining the second compartment; and a switch member pivotally mounted to the head and including a first end engaged with the pawl to move therewith and a second end for manual operation, the switch member being pivotally movable between two positions to optionally cause the biasing means to engage with one of the operative sections of the pawl, thereby allowing change in ratcheting direction of the ratcheting tool, the pawl sliding relative to the switch member when the switch member is pivoted between the two positions; wherein all of the second teeth of the pawl simultaneously mesh with the first teeth of the gear wheel when the switch member is in either one of the two positions.

2. The ratcheting tool as claimed in claim 1, wherein the handle and the head include a web area therebetween, the web area including a cavity for receiving the biasing means.

3. The ratcheting tool as claimed in claim 2, wherein the biasing means includes a ball partially received in the cavity for releasably engaging with one of the operative sections and an elastic member in the cavity for biasing the ball toward said one of the operative sections.

4. The ratcheting tool as claimed in claim 3, wherein each said operative section is a groove having a rectilinear section that is at an angle with a longitudinal direction of the handle.

5. The ratcheting tool as claimed in claim 4, wherein the rectilinear sections of the grooves are spaced by a ridge.

6. The ratcheting tool as claimed in claim 5, wherein the pawl is disengaged from the gear wheel and the ball slides over the ridge during transition from said one of the grooves to the other of the grooves.

7. The ratcheting tool as claimed in claim 3, wherein the pawl is urged to slide relative to the gear wheel and the ball.

8. The ratcheting tool as claimed in claim 1, wherein the pawl includes a vertical slot, and the first end of the switch member includes a peg slidably received in the vertical slot such that pivotal movement of the switch member causes the peg to slide along the vertical slot and thus urge the pawl to move relative to the gear wheel and the biasing means.

9. The ratcheting tool as claimed in claim 1, wherein the gear wheel includes an inner periphery for releasably engaging with a fastener.

10. The ratcheting tool as claimed in claim 1, wherein the gear wheel includes a drive member extended therefrom for releasably engaging with a socket.

11. The ratcheting tool as claimed in claim 1, wherein the plurality of second teeth comprises at least 10 second teeth.

12. The ratcheting tool as claimed in claim 1, wherein the wall defining the second compartment includes a first portion and a second portion spaced from the first portion greater than the length of the first side, with the biasing means biasing the pawl to bear against the first portion of the wall defining the second compartment in one of the two positions of the switch member and biasing the pawl to bear against the second portion of the wall defining the second compartment in the other of the two portions of the switch member.

13. A ratcheting tool comprising:

a handle;

a head extending from the handle and having a first compartment and a second compartment communicating with the first compartment, a web area being defined between the bead and the handle and including a cavity;

a gear wheel rotatably mounted in the first compartment, the gear wheel including an inner periphery adapted to be engaged with a fastener and an outer periphery with a plurality of first teeth;

a pawl mounted in the second compartment and including a first side with a plurality of second teeth facing the first teeth of the gear wheel and a second side facing away from the gear wheel, the second side of the pawl including two grooves spaced by a ridge, the pawl further including a vertical slot;

a ball partially received in the cavity and in operative contact with one of the grooves of the pawl;

an elastic member mounted in the cavity for biasing the pawl toward the gear wheel such that the second teeth of the pawl mesh with the first teeth of the gear wheel and for biasing the pawl to bear against a wall defining the second compartment; and a switch member pivotally mounted to the head and including a first end engaged with the pawl and a second end for manual operation, the switch member being pivotally movable between two positions to optionally cause the ball to engage with one of the grooves of the pawl, thereby allowing change in ratcheting direction of the ratcheting tool, the first end of the switch member including a peg slidably received in the vertical slot such that pivotal movement of the switch member causes the peg to slide along the vertical slot and thus urges the pawl to move relative to the gear wheel and the ball; wherein all of the second teeth of the pawl simultaneously mesh with the first teeth of the gear wheel independent of the position of the switch member.

14. The ratcheting tool as claimed in claim 13, wherein each said groove has a rectilinear section, and the two rectilinear sections of the grooves are spaced by the ridge.

15. The ratcheting tool as claimed in claim 13, wherein the pawl is urged to slide relative to the gear wheel and the ball.

16. The ratcheting tool as claimed in clam 13, wherein the plurality of second teeth comprises at least 10 second teeth.

17. A ratcheting tool comprising:

a handle;

a head extending from the handle and having a first compartment and a second compartment communicating with the first compartment, a web area being defined between the head and the handle and including a cavity;

a gear wheel rotatably mounted in the first compartment, the gear wheel including a drive member extended therefrom and adapted to be engaged with a fastener, the gear wheel further including an outer periphery with a plurality of first teeth;

a pawl mounted in the second compartment and including a first side with a plurality of second teeth facing the first teeth of the gear wheel and a second side facing away from the gear wheel, the second side of the pawl including two grooves spaced by a ridge, the pawl further including a vertical slot;

a ball partially received in the cavity and in operative contact with one of the grooves of the pawl;

an elastic member mounted in the cavity for biasing the pawl toward the gear wheel such that the second teeth of the pawl mesh with the first teeth of the gear wheel and for biasing the pawl to bear against a wall defining the second compartment; and a switch member pivotally mounted to the head and including a first end engaged with the pawl and a second end for manual operation, the switch member being pivotally movable between two positions to optionally cause the ball to engage with one of the grooves of the pawl, thereby allowing change in ratcheting direction of the ratcheting tool, the first end of the switch member including a peg slidably received in the vertical slot such that pivotal movement of the switch member causes the peg to slide along the vertical slot and thus urges the pawl to move relative to the gear wheel and the ball; wherein all of the second teeth of the pawl simultaneously mesh with the first teeth of the gear wheel independent of the position of the switch member.

18. The ratcheting tool as claimed in claim 17, wherein each said groove has a rectilinear section, and the two rectilinear sections of the grooves are spaced by the ridge.

19. The ratcheting tool as claimed in claim 17, wherein the pawl is urged to slide relative to the gear wheel and the ball.

20. The ratcheting tool as claimed in clam 17, wherein the plurality of second teeth comprises at least 10 second teeth.

* * * * *